US009038741B2

(12) United States Patent
Lopez et al.

(10) Patent No.: US 9,038,741 B2
(45) Date of Patent: May 26, 2015

(54) ADJUSTABLE FLOW CONTROL DEVICE

(75) Inventors: Jean Marc Lopez, Plano, TX (US); Stephen Michael Greci, McKinney, TX (US); Luke William Holderman, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 543 days.

(21) Appl. No.: 13/443,859

(22) Filed: Apr. 10, 2012

(65) Prior Publication Data

US 2013/0264072 A1 Oct. 10, 2013

(51) Int. Cl.
*E21B 33/12* (2006.01)
*E21B 34/08* (2006.01)
*E21B 43/08* (2006.01)

(52) U.S. Cl.
CPC ..... *E21B 34/085* (2013.01); *E21B 43/08* (2013.01)

(58) Field of Classification Search
CPC ..... E21B 33/12; E21B 33/13; E21B 43/12; E21B 34/06; E21B 34/00; E21B 32/08; E21B 34/085
USPC ..... 166/386, 135
See application file for complete search history.

(56) References Cited

U.S. PATENT DOCUMENTS 6,719,051 B2 4/2004 Hailey, Jr. et al.
7,383,886 B2 6/2008 Dybevik et al.
7,419,002 B2 9/2008 Dybevik et al.
7,699,101 B2 4/2010 Fripp et al.
7,775,284 B2 8/2010 Richards et al.
7,814,973 B2 10/2010 Dusterhoft et al.
8,230,935 B2 7/2012 Gano et al.
8,256,510 B2 9/2012 Holderman et al.
8,256,522 B2 9/2012 Veit et al.
8,291,972 B2 10/2012 Dusterhoft et al.
8,291,985 B2 10/2012 Holderman
8,302,681 B2 11/2012 Fripp et al.
8,356,668 B2 1/2013 Dykstra et al.
8,356,669 B2 1/2013 Holderman
8,376,047 B2 2/2013 Dykstra et al.
8,430,158 B2 4/2013 Holderman et al.
8,430,173 B2 4/2013 Todd et al.
8,430,174 B2 4/2013 Holderman et al.
8,434,559 B2 5/2013 Todd et al.
8,490,690 B2 7/2013 Lopez
8,499,827 B2 8/2013 Dusterhoft et al.
8,573,311 B2 11/2013 Zhao et al.
8,579,025 B2 11/2013 Holderman et al.
8,584,762 B2 11/2013 Fripp et al.

(Continued)

OTHER PUBLICATIONS

Final Office Action dated Dec. 12, 2012, U.S. Appl. No. 13/408,861, filed Feb. 29, 2012.

(Continued)

*Primary Examiner* — Kenneth L Thompson
*Assistant Examiner* — Michael Wills, III
(74) *Attorney, Agent, or Firm* — Scott Richardson; Baker Botts L.L.P.

(57) ABSTRACT

A flow control device comprises a fluid pathway configured to provide fluid communication between an exterior of a wellbore tubular and an interior of the wellbore tubular, a flow restriction disposed in the fluid pathway, wherein the flow restriction is disposed in a radial alignment with respect to the wellbore tubular, and a flow blockage disposed in the fluid pathway, wherein the flow blockage substantially prevents a fluid flow through the fluid pathway.

20 Claims, 9 Drawing Sheets

(56) References Cited

U.S. PATENT DOCUMENTS

| | | | |
|---|---|---|---|
| 8,596,366 | B2 | 12/2013 | Franklin et al. |
| 8,602,106 | B2 | 12/2013 | Lopez |
| 8,602,110 | B2 | 12/2013 | Kuo et al. |
| 8,657,016 | B2 | 2/2014 | Greci et al. |
| 8,684,087 | B1 | 4/2014 | Lopez |
| 8,684,094 | B2 | 4/2014 | Greci |
| 2005/0121192 | A1 | 6/2005 | Hailey, Jr. et al. |
| 2007/0246407 | A1 | 10/2007 | Richards et al. |
| 2008/0041580 | A1 | 2/2008 | Freyer et al. |
| 2008/0283238 | A1 | 11/2008 | Richards et al. |
| 2009/0084556 | A1 | 4/2009 | Richards et al. |
| 2009/0151925 | A1 | 6/2009 | Richards et al. |
| 2011/0056677 | A1 | 3/2011 | Holderman |
| 2011/0083860 | A1 | 4/2011 | Gano et al. |
| 2013/0048301 | A1 | 2/2013 | Gano et al. |
| 2013/0118729 | A1 | 5/2013 | Greci |
| 2013/0153238 | A1 | 6/2013 | Fripp et al. |
| 2013/0186626 | A1 | 7/2013 | Aitken et al. |
| 2013/0213667 | A1 | 8/2013 | Lopez et al. |
| 2013/0276901 | A1 | 10/2013 | Holderman |
| 2013/0277059 | A1 | 10/2013 | Holderman et al. |
| 2013/0284452 | A1 | 10/2013 | Franklin et al. |
| 2014/0000869 | A1 | 1/2014 | Holderman et al. |
| 2014/0014345 | A1 | 1/2014 | Veit et al. |
| 2014/0020898 | A1 | 1/2014 | Holderman et al. |
| 2014/0027104 | A1 | 1/2014 | Holderman |
| 2014/0034308 | A1 | 2/2014 | Holderman et al. |
| 2014/0048279 | A1 | 2/2014 | Holderman |

OTHER PUBLICATIONS

Advisory Action dated Feb. 19, 2013, U.S. Appl. No. 13/408,861 filed Feb. 29, 2012.

Advisory Action dated Jan. 25, 2013, U.S. Appl. No. 13/452,749, filed Apr. 20, 2012.

Greci, Stephen Michael, et al., PCT Application entitled, "Adjustable Flow Control Device", filed Feb. 14, 2013, PCT Serial No. PCT/US13/26032.

Lopez, Jean Marc, et al., Patent Application entitled "Adjustable Flow Control Device," filed Feb. 20, 2013, PCT Serial No. PCT/US13/26764.

FAIPP Office Action dated Sep. 19, 2012, U.S. Appl. No. 13/408,861, filed Feb. 29, 2012.

Final Office Action dated Nov. 14, 2012, U.S. Appl. No. 13/452,749, filed Apr. 20, 2012.

Foreign Communication from a Related Counterpart Application, International Search Report and Written Opinion dated Jun. 2, 2013, PCT/US13/26032, filed on Feb. 14, 2013.

Foreign Communication from a Related Counterpart Application, International Search Report and Written Opinion dated May 27, 2013, PCT/US13/26764, filed on Feb. 20, 2013.

Notice of Allowance dated Jun. 28, 2013, U.S. Appl. No. 13/408,861, filed Feb. 29, 2012.

Notice of Allowance dated Jul. 12, 2013, U.S. Appl. No. 13/408,861, filed Feb. 29, 2012.

Greci, Stephen Michael, et al., Patent Application entitled "Adjustable Flow Control Device," filed Feb. 29, 2012, U.S. Appl. No. 13/408,861.

Greci, Stephen Michael, et al., Patent Application entitled "Adjustable Flow Control Device," filed Apr. 20, 2012, U.S. Appl. No. 13/452,749.

Pre-Interview Communication dated Aug. 2, 2012, U.S. Appl. No. 13/408,861, filed Feb. 29, 2012.

Office Action dated Jun. 20, 2012, U.S. Appl. No. 13/452,749, filed Apr. 20, 2012.

ADJUSTABLE FLOW CONTROL DEVICE

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes drilled into subterranean formations to produce one or more fluids from the subterranean formation. For example, a wellbore may be used to produce one or more hydrocarbons. Additional components such as water may also be produced with the hydrocarbons, though attempts are usually made to limit water production from a wellbore or a specific interval within the wellbore. Other components such as hydrocarbon gases may also be limited for various reasons over the life of a wellbore.

Where fluids are produced from a long interval of a formation penetrated by a wellbore, it is known that balancing the production of fluid along the interval can lead to reduced water and gas coning, and more controlled conformance, thereby increasing the proportion and overall quantity of oil or other desired fluid produced from the interval. Various devices and completion assemblies have been used to help balance the production of fluid from an interval in the wellbore. For example, inflow control devices (ICD's) have been used in conjunction with well screens to restrict the flow of produced fluid through the screens for the purpose of balancing production along an interval. For example, in a long horizontal wellbore, fluid flow near a heel of the wellbore may be more restricted as compared to fluid flow near a toe of the wellbore, to thereby balance production along the wellbore.

SUMMARY

In an embodiment, a flow control device comprises a fluid pathway configured to provide fluid communication between an exterior of a wellbore tubular and an interior of the wellbore tubular, a flow restriction disposed in the fluid pathway, wherein the flow restriction is disposed in a radial alignment with respect to the wellbore tubular, and a flow blockage disposed in the fluid pathway, wherein the flow blockage substantially prevents a fluid flow through the fluid pathway.

In an embodiment, a flow control device comprises a fluid pathway configured to provide fluid communication between an exterior of a wellbore tubular and an interior of the wellbore tubular, a plurality of flow restrictions disposed in series in the fluid pathway, a flow blockage disposed in the fluid pathway, wherein the flow blockage substantially prevents a fluid flow through the fluid pathway, and a retaining member configured to maintain the flow blockage within the fluid pathway and allow access to the flow blockage within the fluid pathway.

In an embodiment, a method comprises providing a flow control device comprising: a plurality of fluid pathways between an exterior of a wellbore tubular and an interior of the wellbore tubular, and a plurality of flow restrictions disposed in the plurality of fluid pathways, wherein at least one of the plurality of flow restrictions is disposed in a radial alignment with respect to the wellbore tubular, and selectively installing or removing one or more flow blockages from the plurality of fluid pathways.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
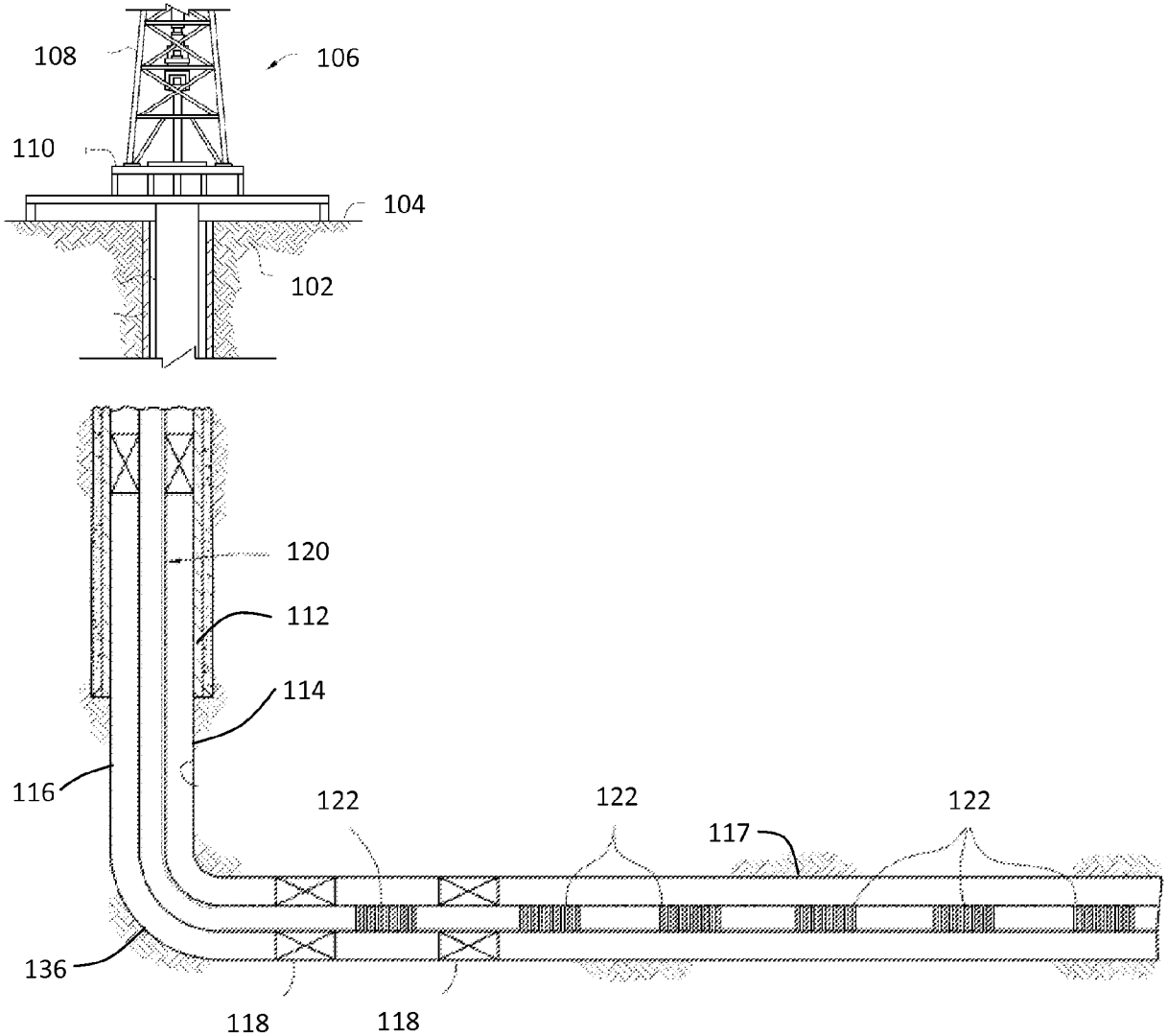
FIG. 1 is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper,"

"upward," "upstream," or "above" meaning toward the surface of the wellbore and with "down," "lower," "downward," "downstream," or "below" meaning toward the terminal end of the well, regardless of the wellbore orientation. The various characteristics mentioned above, as well as other features and characteristics described in more detail below, will be readily apparent to those skilled in the art with the aid of this disclosure upon reading the following detailed description of the embodiments, and by referring to the accompanying drawings.

Disclosed herein is an adjustable flow control device for use in a wellbore, which may be used as an ICD. The flow control device may form a part of a well screen assembly and may comprise a fluid pathway that may be selectively adjusted to either allow fluid flow or substantially prevent fluid flow. The flow through the flow control device can then be adjusted based on a desired resistance to flow and/or flow rate from an interval in a wellbore, thereby allowing for the production from one or more intervals in a wellbore to be balanced. In some embodiments, the flow control device can include a plurality of fluid pathways and flow restrictions, each of which may be selectively and individually adjusted to provide a desired total resistance to flow and/or overall flowrate to be selected. The plurality of flow restrictions may each have different resistances to flow, thereby providing for a wide range of overall resistances and/or flowrates. Thus, the adjustable flow control device may be used to fine tune the production from a wellbore, which may be advantageous relative to other ICDs having relatively fixed resistances and/or flow rates.

Various configurations of the flow restrictions are possible. For example, a flow restriction may be disposed in a radial alignment with respect to a wellbore tubular, which may allow the size (e.g., the diameter) to be increased without a corresponding increase in the diameter of the well screen assembly. In addition, a plurality of flow restrictions may be used with the well screen assemblies, thereby allowing a fine tuning of the resistance to flow through the fluid pathways. The plurality of flow restrictions may be disposed in series within the fluid pathway, which may allow for a configuration of the flow restrictions that can present a differential resistance to the flow of various fluids. For example, the flow restrictions can be configured to provide a higher resistance to the flow of water relative to the flow of oil.

The adjustable flow control device disclosed herein may allow for selective adjustment of an individual fluid pathway without removing a flow restriction disposed in the fluid pathway. To enable this type of access, a retaining member can be used to provide individual and direct access to each fluid pathway and allow for a flow blockage to be disposed and/or removed from the fluid pathway. This may be advantageous relative to other ICDs requiring entire sets of pathways to either be opened or sealed shut. In addition, the retaining member may be directly accessible from an exterior of the flow control device, thereby saving time relative to other designs requiring the removal of a cover and/or sleeve. Further, the ease with which the flow control device disclosed herein may be adjusted can allow for the adjustment and/or readjustment of the flow through the flow control device one or more times between being manufactured and being disposed in a wellbore. These and other advantages are described in more detail herein.

Referring to FIG. 1, an example of a wellbore operating environment in which a flow control device may be used is shown. As depicted, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 117. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further, the wellbore may be used for both producing wells and injection wells.

A wellbore tubular string 120 may be lowered into the subterranean formation 102 for a variety of drilling, completion, workover, treatment, and/or production processes throughout the life of the wellbore. The embodiment shown in FIG. 1 illustrates the wellbore tubular 120 in the form of a completion assembly string disposed in the wellbore 114. It should be understood that the wellbore tubular 120 is equally applicable to any type of wellbore tubulars being inserted into a wellbore including as non-limiting examples drill pipe, casing, liners, jointed tubing, and/or coiled tubing. Further, the wellbore tubular 120 may operate in any of the wellbore orientations (e.g., vertical, deviated, horizontal, and/or curved) and/or types described herein. In an embodiment, the wellbore may comprise wellbore casing 112, which may be cemented into place in the wellbore 114.

In an embodiment, the wellbore tubular string 120 may comprise a completion assembly string comprising one or more wellbore tubular types and one or more downhole tools (e.g., zonal isolation devices 118, screens, valves, etc.). The one or more downhole tools may take various forms. For example, a zonal isolation device 118 may be used to isolate the various zones within a wellbore 114 and may include, but is not limited to, a packer (e.g., production packer, gravel pack packer, frac-pac packer, etc.). In an embodiment, the wellbore tubular string 120 may comprise a plurality of well screen assemblies 122, which may be disposed within the horizontal wellbore portion 117. The zonal isolation devices 118, may be used between various ones of the well screen assemblies 122, for example, to isolate different zones or intervals along the wellbore 114 from each other.

The workover and/or drilling rig 106 may comprise a derrick 108 with a rig floor 110 through which the wellbore tubular 120 extends downward from the drilling rig 106 into the wellbore 114. The workover and/or drilling rig 106 may comprise a motor driven winch and other associated equipment for conveying the wellbore tubular 120 into the wellbore 114 to position the wellbore tubular 120 at a selected depth. While the operating environment depicted in FIG. 1 refers to a stationary workover and/or drilling rig 106 for conveying the wellbore tubular 120 within a land-based wellbore 114, in alternative embodiments, mobile workover rigs, wellbore servicing units (such as coiled tubing units), and the like may be used to convey the wellbore tubular 120 within the wellbore 114. It should be understood that a wellbore tubular 120 may alternatively be used in other operational environments, such as within an offshore wellbore operational environment.

The flow control device described herein allows for the resistance to flow and/or the flow rate through the flow control device to be selectively adjusted. The flow control device described herein generally comprises a flow restriction disposed in a fluid pathway between an exterior of a wellbore tubular and an interior of the wellbore tubular, a flow blocker disposed in the fluid pathway, where the flow blocker is configured to substantially prevent a fluid flow through the fluid pathway, and a retaining member configured to maintain the flow blocker within the fluid pathway. The flow control device may be adjusted while leaving the flow restriction in position in the fluid pathway. In addition, the flow control device may be adjusted by directly accessing the fluid pathway through the retaining member from the outside of the flow control device.

Figure 2A:
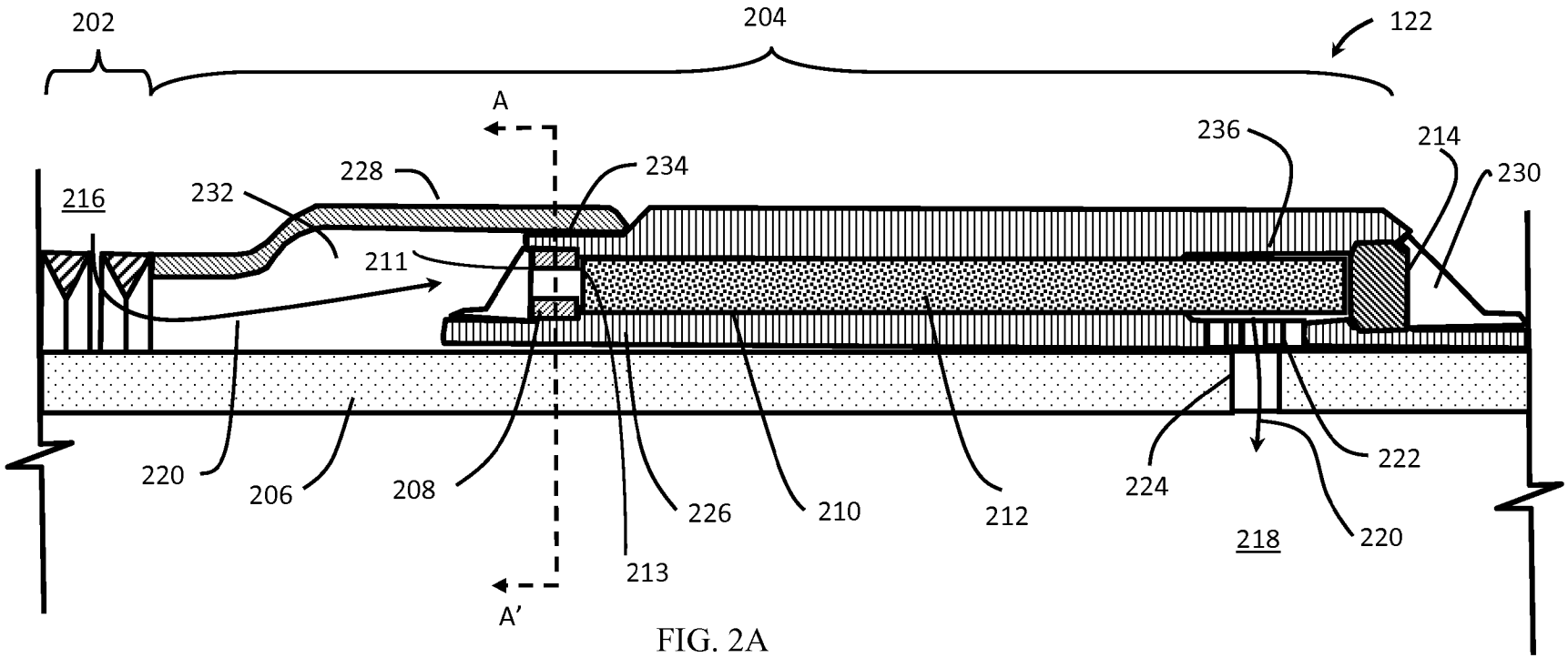
FIG. 2A is a partial cross-sectional view of a well screen assembly comprising an embodiment of a flow control device.

Referring now to FIG. 2A, a schematic partial cross-sectional view of one of the well screen assemblies 122 comprising a flow control device is representatively illustrated at an enlarged scale. The flow control device of the well screen assembly 122 is one of several different examples of flow control devices described below in alternate configurations. The well screen assembly 122 generally comprises a filter portion 202 and a flow control device 204. The filter portion 202 is used to filter at least a portion of any sand and/or other debris from a fluid that generally flows from an exterior 216 to an interior of the screen assembly 122. The filter portion 202 is depicted in FIG. 2A as being of the type known as "wire-wrapped," since it is made up of a wire closely wrapped helically about a wellbore tubular 206, with a spacing between the wire wraps being chosen to keep sand and the like that is greater than a selected size from passing between the wire wraps. Other types of filter portions (such as sintered, woven and/or non-woven mesh, pre-packed, expandable, slotted, perforated, etc.) may also be used. The filter portion 202 may also comprise one or more layers of the filter material. A fluid pathway 210 can be disposed between the filter portion 202 and the wellbore tubular 206 to allow a fluid passing through the filter portion 202 to flow along the outer surface of the wellbore tubular to the flow control device 204.

The flow control device 204 may perform several functions. In an embodiment, the flow control device 204 is an ICD which functions to restrict flow therethrough, for example, to balance production of fluid along an interval. The flow control device 204 generally comprises a flow restriction 208 disposed within a fluid pathway 210 between an exterior 216 of the wellbore tubular 206 and an interior throughbore 218 of the wellbore tubular 206. In an embodiment, the flow restriction 208 is disposed within a housing 226. The housing 226 can comprise a generally cylindrical member disposed about the wellbore tubular 206. The housing 226 may be fixedly engaged with the wellbore tubular 206 and one or more seals may be disposed between the housing 226 and the exterior surface of the wellbore tubular 206 to provide a substantially fluid tight engagement between the housing 226 and the wellbore tubular 206.

Figure 2B:
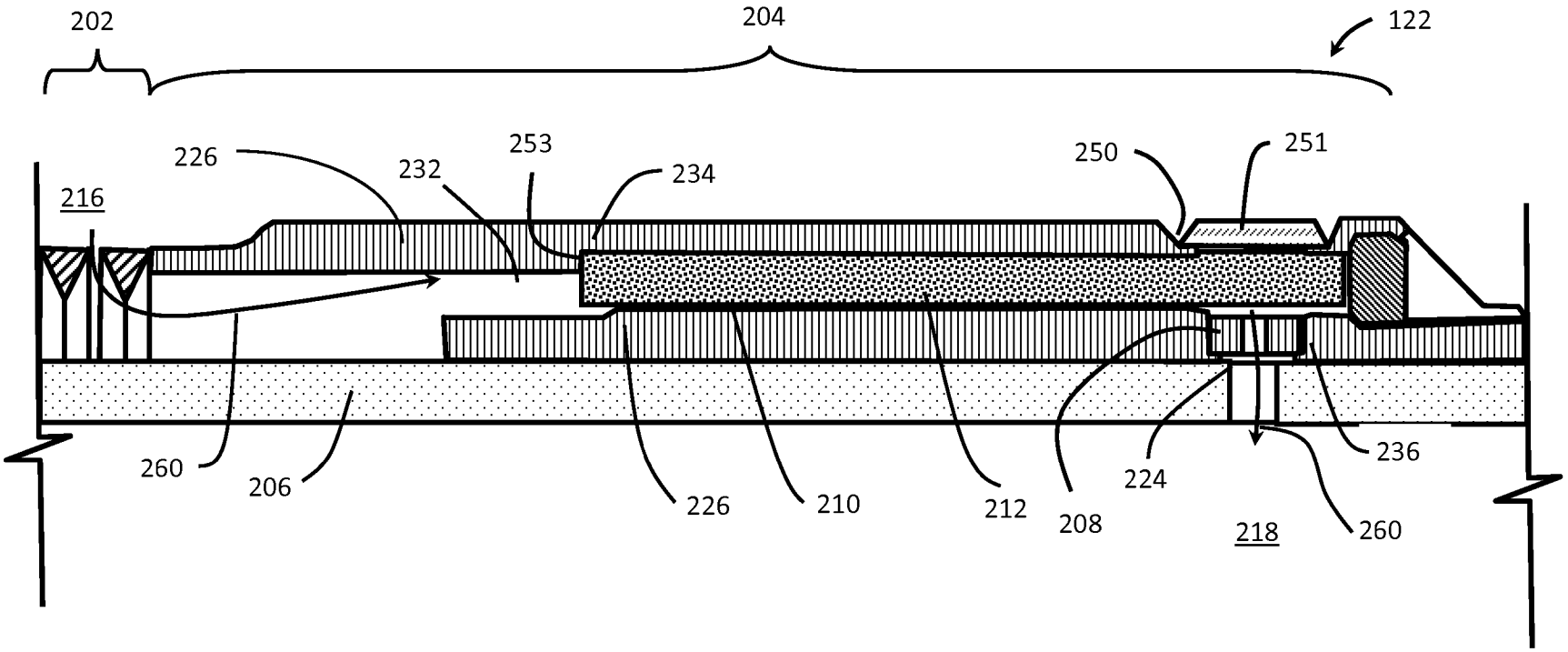
FIG. 2B is another partial cross-sectional view of a well screen assembly comprising an embodiment of a flow control device.

A sleeve 228 comprising an annular member may be disposed about a portion of the housing 226 and a section of the filter portion 202. The sleeve 228 forms a sealing engagement with an outer surface of the housing 226, and one or more seals (e.g., o-rings) may be used in corresponding recesses in the sleeve 228 and/or the housing 226 to aid in forming the sealing engagement. The sleeve 228 may be configured to engage a portion of the filter portion 202 and prevent fluid from passing into the housing 226 without first passing through the filter portion 202. A chamber 232 may be defined between the interior surface of the sleeve 228, the outer surface of the wellbore tubular 206, the housing 226 and the filter portion 202. While illustrated as a separate component from the housing 226, the sleeve 228 may be integral with the housing 226 and/or the housing 226 and the sleeve 228 may be a single, unitary component (e.g., as shown in FIG. 2B).

Any fluid passing through the filter portion 202 and the chamber 232 may be directed to the fluid pathway 210 disposed in a generally longitudinal direction through the housing 226. The fluid pathway 210 may provide a fluid communication route between the interior throughbore 218 and the exterior 216 of the wellbore tubular 206. The fluid pathway 210 may generally comprise a cylindrical throughbore, though other cross-sectional shapes such as oval, square, rectangular, trapezoidal, etc. may also be used. The fluid pathway 210 generally extends from a first end 234 of the housing 226 in fluid communication with the chamber 232 to a second portion 236 of the housing 226 having one or more ports 222 disposed therein. The ports 222 may align with one or more ports 224 disposed in the wellbore tubular 206, and together, the ports 222, 224 may provide a fluid communication route between the fluid pathway 210 and the interior throughbore 218 of the wellbore tubular 206. The ports 222 and/or ports 224 may generally comprise apertures with square, rounded, slotted, or other configurations.

Figure 3:
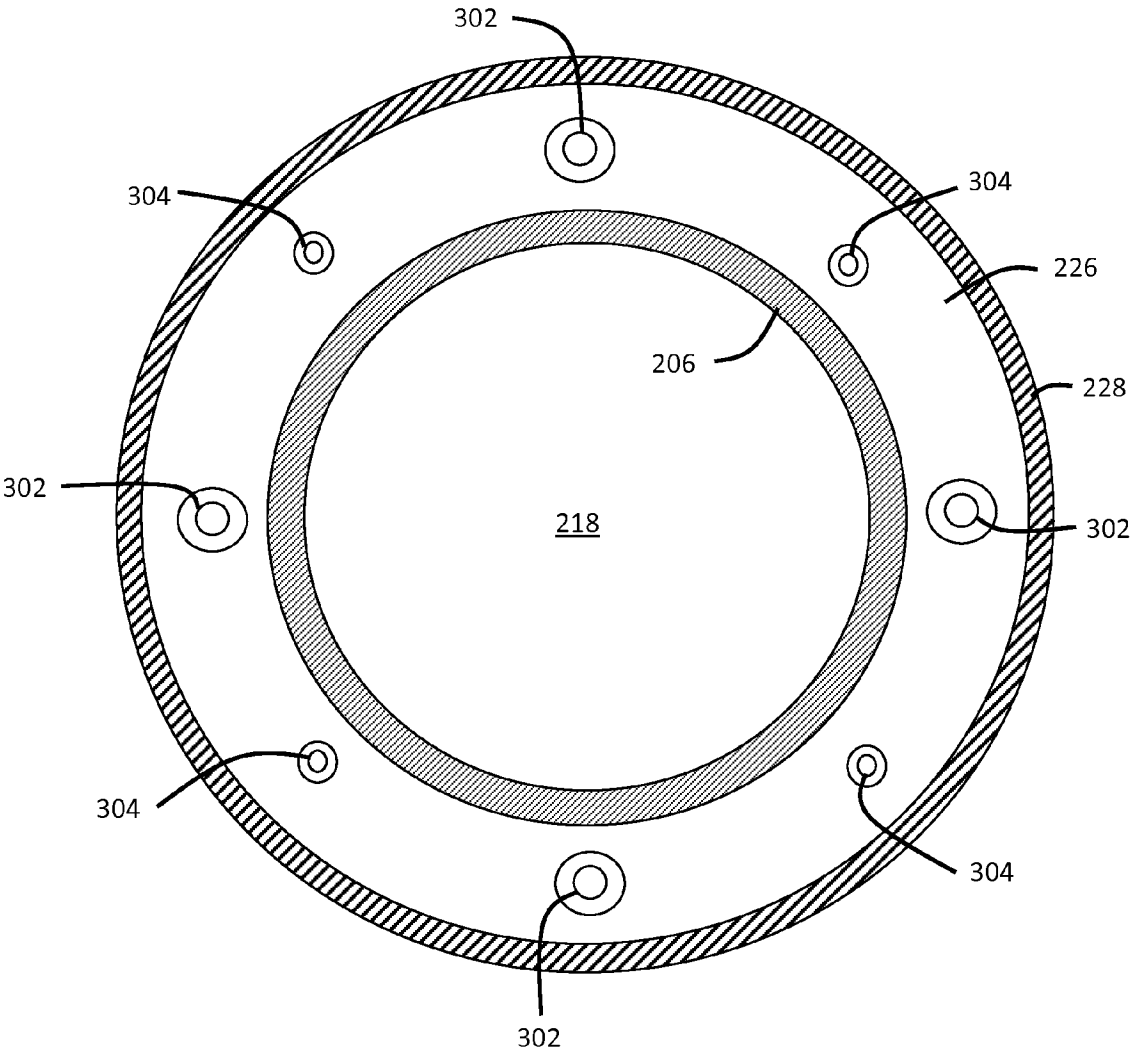
FIG. 3 is a partial cross-sectional view of an embodiment of a flow control device along line A-A' of FIG. 2A.

In an embodiment, a plurality of fluid pathways 210 can be disposed in the housing 226 about the circumference of the wellbore tubular 206. FIG. 3 illustrates a cross-sectional view of an embodiment of a flow control device along line A-A' of FIG. 2A. In this embodiment, eight flow restrictions 302, 304 are disposed in eight corresponding fluid pathways in the housing 226 about the wellbore tubular 206. Each of the fluid pathways may be configured to provide fluid communication between the exterior 216 of the wellbore tubular 206 and the interior throughbore 218 of the wellbore tubular 206. While FIG. 3 illustrates eight fluid pathways any number of fluid pathways may be used with the flow control device described herein within the limits of the available space for fluid pathways 210 in the housing 226. In an embodiment, the flow control device may comprise between about 1 and about 12 fluid pathways, alternatively between about 2 and about 10 fluid pathways. In some embodiments, more than 12 fluid pathways may be provided in the housing 226 to provide a greater flow area for a larger fluid flowrate through the flow control device.

In an embodiment, the fluid pathways may be evenly distributed about the wellbore tubular 206 or the fluid pathways 210 may not be evenly distributed. For example, an eccentric alignment of the wellbore tubular 206 within the housing 226 may allow for the use of an eccentric alignment of the fluid pathways about the wellbore tubular 206. In an embodiment, each fluid pathway 210 may have the same or different diameter and/or longitudinal length.

Returning to FIG. 2A, the flow restriction 208 may generally be disposed within the fluid pathway 210 between the first end 234 and the one or more ports 222. The flow restriction 208 is configured to provide a desired resistance to fluid flow through the flow restriction 208. The flow restriction 208 may be selected to provide a resistance for balancing the production along an interval. Various types of flow restrictions 208 can be used with the flow control device described herein. In the embodiment shown in FIG. 2A, the flow restriction comprises a nozzle that comprises a central opening (e.g., an orifice) configured to cause a specified resistance and pressure drop in a fluid flowing through the flow restriction 208. The central opening may have a variety of configurations from a rounded cross-section, to cross section in which one or more of the first edge 211 or the second edge 213 comprises a sharp-squared edge. In general, the use of a squared edge at either the first edge 211 and/or the second edge 213 may result in a greater pressure drop through the orifice than other shapes. Further, the use of a squared edge may result in a pressure drop through the flow restrictor that depends on the viscosity of the fluid passing through the flow restriction. The use of a squared edge may result in a greater pressure drop through the flow restrictor for an aqueous fluid than a hydrocarbon fluid, thereby presenting a greater resistance to flow for any water being produced relative to any hydrocarbons (e.g., oil) being produced. Thus, the use of a central opening comprising a squared edge may advantageously resist the flow of water as compared to the flow of hydrocarbons. In some embodiments described herein, a plurality of nozzle type flow restrictions may be used in series.

The flow restrictions 208 may also comprise one or more restrictor tubes. The restrictor tubes generally comprise tubular sections with a plurality of internal restrictions (e.g., orifices). The internal restrictions are configured to present the greatest resistance to flow through the restrictor tube. The restrictor tubes may generally have cylindrical cross-sections, though other cross-sectional shapes are possible. The restrictor tubes may be disposed within the fluid pathway 210 with the fluid passing through the interior of the restrictor tubes, and the restrictor tubes may generally be aligned with the longitudinal axis of the wellbore tubular within the fluid pathway 210. The plurality of internal restrictions may then provide the specified resistance to flow.

The internal restrictions may be the same or similar to the central openings described with respect to the nozzle type flow restrictions above. In an embodiment, one or more of the internal restrictions may comprise a square edged. In some embodiments, one or both of the edges can be provided without a fillet or chamfer added to the edge and can even be manufactured to be sharp. The internal restrictions may have squared shoulders at the interior edges between the internal restrictions and the inner surface of the restrictor tube. In an embodiment, the longitudinal length of the restrictor tube may be at least two times greater than the longitudinal length of any of the one or more internal restrictions. The configuration of the internal restrictions (e.g., cross-sectional shape, internal diameter, longitudinal length, etc.) can be the same or different for each of the internal restrictions of the plurality of internal restrictions. As with the use of one or more nozzle type flow restrictions, the use of a restrictor tube comprising a plurality of internal restrictions that comprise one or more squared edges may advantageously resist the flow of water as compared to the flow of hydrocarbons.

Other suitable flow restrictions may also be used including, but not limited to, narrow flow tubes, annular passages, bent tube flow restrictors, helical tubes, and the like. Narrow flow tubes may comprise any tube having a ratio of length to diameter of greater than about 2.5 and providing for the desired resistance to flow. Similarly, annular passages comprise narrow flow passages that provide a resistance to flow due to frictional forces imposed by surfaces of the fluid pathway. A bent tube flow restrictor comprises a tubular structure that forces fluid to change direction as it enters and flows through the flow restrictor. Similarly, a helical tube flow restrictor comprises a fluid pathway that forces the fluid to follow a helical flow path as it flows through the flow restrictor. The repeated change of momentum of the fluid through the bent tube and/or helical tube flow restrictors increases the resistance to flow and can allow for the use of a larger flow passage that may not clog as easily as the narrow flow passages of the narrow flow tubes and/or annular passages. Each of these different flow restriction types may be used to provide a desired resistance to flow and/or pressure drop for a fluid flow through the flow restrictor. Since the resistance to flow may change based on the type of fluid, the type of flow restriction may be selected to provide the desired resistance to flow for one or more type of fluid.

The flow restriction can be subject to erosion and/or abrasion from fluids passing through the flow restriction. Accordingly, the flow restriction, or at least those portions contacting the fluid flow can be formed from any suitable erosion and/or abrasion resistant materials. Suitable materials may comprise various hard materials such as various steels, tungsten, niobium, vanadium, molybdenum, silicon, titanium, tantalum, zirconium, chromium, yttrium, boron, carbides (e.g., tungsten carbide, silicon carbide, boron carbide), nitrides (e.g., silicon nitride, boron nitride), oxides, silicides, alloys thereof, and any combinations thereof. In an embodiment, one or more of these hard materials may form a portion of a composite material. For example, the hard materials may form a particulate or discontinuous phase useful in resisting erosion and/or abrasion, and a matrix material may bind the hard particulate phase. Suitable matrix materials may comprise copper, nickel, iron, cobalt, alloys thereof, and any combination thereof. Since machining hard, abrasion, erosion and/or wear resistant materials is generally both difficult and expensive, the flow restrictions may be formed from a metal in a desired configuration and subsequently one or more portions of the flow restriction may be treated to provide the desired abrasion, erosion and/or wear resistance. Suitable surface treatments used to provide erosion and/or abrasion resistance can include, but are not limited to, carburizing, nitriding, heat treating, and any combination thereof. In embodiments in which erosion and/or abrasion is not a concern, additional suitable materials such as various polymers may also be used.

In an embodiment in which multiple fluid pathways 210 are disposed in the housing 226 about the wellbore tubular 206, one or more flow restrictions 208 may be disposed in each fluid pathway 210. The design and type of flow restriction 208 may change for each of the one or more flow restrictions disposed in each fluid pathway 210. For example, the type of flow restrictions 208 in each fluid pathway may each be the same or different.

In an embodiment, the design of each of the one or more flow restrictions disposed in each fluid pathway 210 may also be the same or different. In an embodiment as shown in FIG. 3 where the flow restrictions comprise nozzle type flow restrictions, the configuration (e.g., size, cross-sectional shape, etc.) of the central openings may determine the resistance to flow and pressure drop through each flow restriction 302, 304. Each of the flow restrictions 302, 304 disposed in each fluid pathway 210 may have a differently sized central opening, thereby providing some flow restrictions 302 with a lower resistance to flow (e.g., using larger central openings) than other flow restrictions 304 with a higher resistance to flow (e.g., using smaller central openings). In the embodiment illustrated in FIG. 3, the flow restrictions 302 may have larger central openings than the flow restrictions 304. A combination of the large flow restrictions 302 and small flow restrictions 304 may then be used to provide a desired total flow resistance and/or flow rate through the flow control device. While only two central opening sizes are illustrated in FIG. 3, it should be appreciated that there may also be three or more different sizes, and in an embodiment, each flow restriction may have a differently sized restriction. Further, one or more additional flow restrictions may be disposed in line with the flow restrictions 302, 304. In an embodiment, the total or overall flow rate and resistance to flow through the flow control device may be a function of the combination of each of the individual flow rates and resistances as provided by the plurality of flow restrictions 208 disposed in the plurality of fluid pathways 210. The ability to use combinations of flow restrictions 208 having different resistances to fluid flow may allow a wide range of total flow rates and resistances to flow to be selected for a given flow control device, thereby providing for the ability to balance production along an interval.

Returning to the embodiment of FIG. 2A, the flow restriction 208 may be fixedly engaged within the fluid pathway 210. For example, the flow restriction 208 may be press fitted, snap fitted, shrunk-fit, bonded (e.g., adhered, soldered, welded, brazed, etc.), and/or integrally formed with the housing so as to not be removable from the housing 226. In some contexts this may be referred to as being permanently installed within the housing 226. In some embodiments, the flow restriction 208 may be engaged with the housing 226 so as not to be permanently engaged with the housing 226, but so as to only be accessible through the removal of one or more portions of the flow control device, such as the sleeve 228. In an embodiment, the flow restriction 208 may not be accessible and/or removable through the access port 230 and/or retaining member 214 recess in the housing 226.

During production operations, the fluid 220 would typically flow from the exterior 216 of the wellbore tubular 206 to the screen assembly 122, through the filter portion 202, and to the flow control device 204. Within the flow control device 204, the fluid 220 can flow through the chamber 232, through the flow restriction 208, which may provide a resistance to the flow of the fluid 220, through the fluid pathway 210, through the one or more ports 222 in the housing 226, and then through the one or more ports 224 disposed in the wellbore tubular 206. The fluid 220 can then flow into the interior throughbore 218 of the wellbore tubular 206, which extends longitudinally through the flow control device as part of the tubular string 120. The fluid 220 can be produced through the tubular string 120 to the surface. The fluid 220 may also flow outwardly through the filter portion 202 and/or the flow control device 204. For example, at times during completion operations the fluid 220 may flow from the interior throughbore 218 of the wellbore tubular 206 outwardly towards the exterior 216 of the wellbore tubular 206. While described in terms of the specific arrangement of the filter portion 202 and the flow control device 204, the flow control device 204 could be upstream of the filter portion 202 relative to a fluid flowing from the exterior 216 of the wellbore tubular 206 to the interior throughbore 218.

Other configurations of the well screen assemblies 122 are also possible. As shown in FIG. 2B, the fluid pathway 210 generally extends from the first end 234 of the housing 226 in fluid communication with the chamber 232 to the second portion 236 of the housing 226. Rather than have a port in the housing 226, the flow restriction 208 may be disposed in the housing 226 between the second portion 236 and the one or more ports 224 disposed in the wellbore tubular 206, which provide a fluid pathway into the interior throughbore 218 of the wellbore tubular 206. In an embodiment, the flow restriction 208 comprises a nozzle type flow restriction, and the central opening of the nozzle type flow restriction may be aligned in a radial direction (i.e., in a direction substantially perpendicular to the longitudinal axis of the wellbore tubular 206). In order to allow a flow blockage to be retained in the fluid pathway 210, the housing 226 may comprise a shoulder 253 or other reduction in the inner diameter of the fluid pathway 210 to provide a surface to engage the flow blockage 212. In this embodiment, the flow blockage 212 may be disposed in the fluid pathway 210 between the exterior 216 of the wellbore tubular 206 and the flow restriction 208. The radial alignment of the flow restriction 208 may allow a flow restriction having a larger diameter to be used without increasing the overall diameter of the well screen assembly 122.

The flow restriction 208 can be installed in the radial alignment using any of the methods for installing the flow restriction 208 described herein. In an embodiment, an access port 250 can be provided in the housing 226 in radial alignment with the flow restriction 208 to provide access for installing the flow restriction 208. A cap 251 can be engaged in the access port 250 after the flow restriction 208 is disposed in the housing 226. The cap may be press fitted, snap fitted, shrunk-fit, bonded (e.g., adhered, soldered, welded, brazed, etc.), or any combination thereof so as to not be removable from the housing 226 once installed.

In the embodiment shown in FIG. 2B, the fluid 260 entering the well screen assembly 122 through the filter portion 202 would typically flow through the chamber 232, through the fluid pathway 210, through the flow restriction 208 aligned in the radial direction, and then through the one or more ports 224 disposed in the wellbore tubular 206. The fluid 260 can then flow into the interior throughbore 218 of the wellbore tubular 206, which extends longitudinally through the flow control device as part of the tubular string 120. The fluid 260 may also flow outwardly through the filter portion 202 and/or the flow control device 204 along the reverse flow path.

Figure 2C:
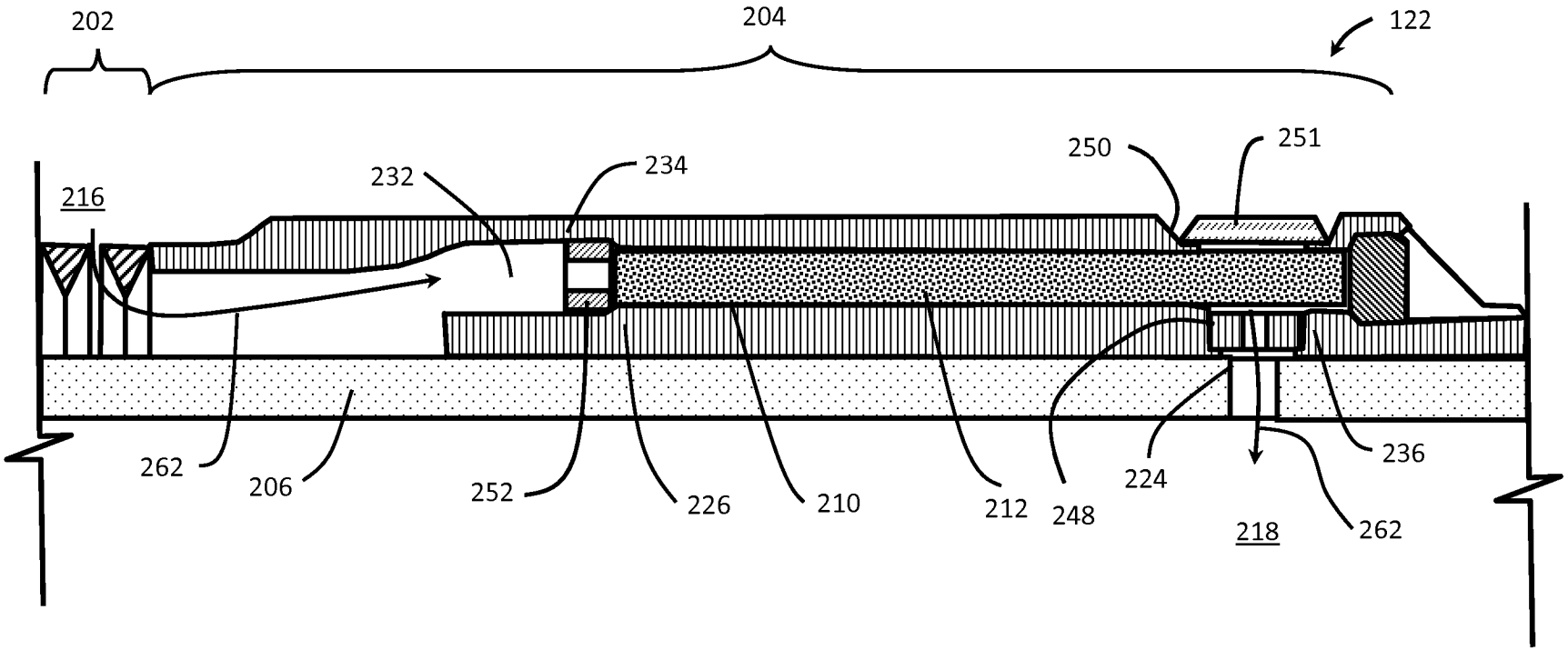
FIG. 2C is still another partial cross-sectional view of a well screen assembly comprising an embodiment of a flow control device.

Still another embodiment of the well screen assembly 122 is shown in FIG. 2C. In this embodiment, a plurality flow restrictions may be disposed within the fluid pathway 210 between the interior throughbore 218 and the exterior 216 of the wellbore tubular 206. A first flow restriction 252 may be disposed in the housing 226 adjacent the chamber 232 and a second flow restriction 248 may be disposed in the housing 226 between the second portion 236 and the one or more ports 224 disposed in the wellbore tubular 206. The first flow restriction 252 may be generally aligned with the longitudinal axis of the wellbore tubular 206, and the second flow restriction 248 may be radially aligned as described with respect to FIG. 2B. In this embodiment, the flow blockage 212 may be disposed in the fluid pathway 210 between the first flow restriction 252 and the second flow restriction 248. In an embodiment, the second flow restriction 248 may comprise a nozzle type flow restriction, and the first flow restriction 252 may comprise another nozzle type flow restriction or any of the other flow restriction types described herein. The flow restrictions 248, 252 may be installed using any of the methods described herein. As described above, the use of a nozzle type flow restriction may provide a different resistance to flow for different types of fluids. Having multiple nozzle type flow restrictions in series may then be used to provide an increased resistance to the production of water through the flow control device 204 relative to the resistance to the production of a liquid hydrocarbon.

In the embodiment shown in FIG. 2C, the fluid 262 entering the well screen assembly 122 through the filter portion 202 would typically flow through the chamber 232, through the first flow restriction 252, through the fluid pathway 210, through the second flow restriction 248 aligned in the radial direction, and then through the one or more ports 224 disposed in the wellbore tubular 206. The fluid 262 can then flow into the interior throughbore 218 of the wellbore tubular 206, which extends longitudinally through the flow control device as part of the tubular string 120. The fluid 262 may also flow outwardly through the filter portion 202 and/or the flow control device 204 along the reverse flow path.

Figure 2D:
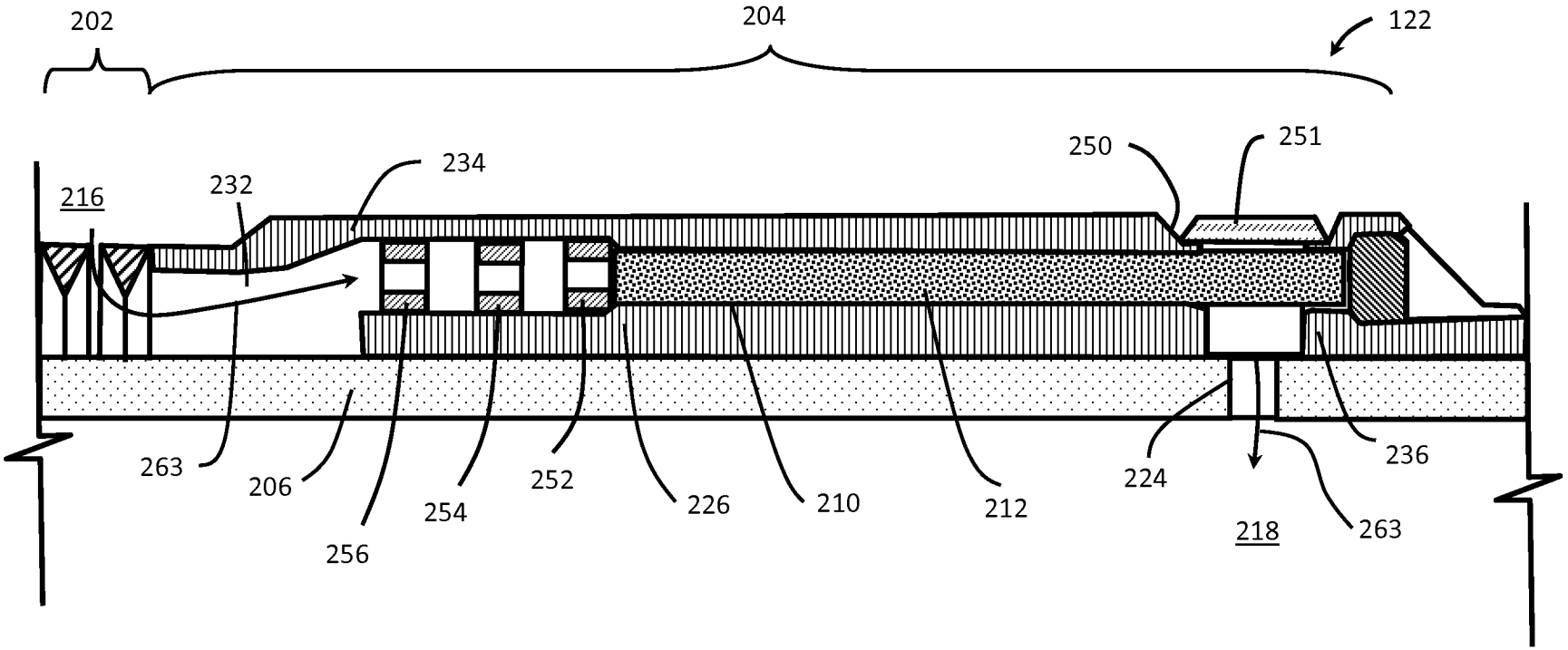
FIG. 2D is yet another partial cross-sectional view of a well screen assembly comprising an embodiment of a flow control device.

Yet another embodiment of the well screen assembly 122 is shown in FIG. 2D. In this embodiment, a plurality flow restrictions may be disposed in series within the fluid pathway 210 between the interior throughbore 218 and the exterior 216 of the wellbore tubular 206. A first flow restriction 252, a second flow restriction 254, and a third flow restriction 256 may be disposed in series within the fluid pathway 210. Each of the flow restrictions 252, 254, 256 may generally be aligned with the longitudinal axis of the wellbore tubular 206. The flow restrictions 252, 254, 256 may be installed using any of the methods described herein. While three flow restrictions 252, 254, 256 are shown, two flow restrictions, or more than three flow restrictions may be disposed in series within the fluid pathway 210. While not illustrated, another flow restriction may be disposed adjacent the one or more ports 224, which may be disposed in a radial alignment. In an embodiment, the flow restrictions 252, 254, 256 may comprise nozzle type flow restrictions. Each of the nozzle type flow restrictions may have the same or different configuration. As described above, the use of a nozzle type flow restriction may provide a different resistance to flow for different types of fluids. Having multiple nozzle type flow restrictions in series may then be used to provide an increased resistance to the production of water through the flow control device 204 relative to the resistance to the production of a liquid hydrocarbon. Thus, an appropriate number of flow restrictions of a desired configuration may be selected and disposed in series to produce the appropriate differential resistance to flow.

While illustrated as nozzle type flow restrictions, one or more of the plurality of flow restrictions disposed in series may comprise any of the other types of flow restrictions described herein. In an embodiment, the flow restrictions may be formed as a single flow restrictor tube having a plurality of internal restrictions along its length. This configuration may provide a plurality of flow restrictions along the length of the fluid pathway 210 between the interior throughbore 218 and the exterior 216 of the wellbore tubular 206. In some embodiments, one or more other type of flow restriction may be used as one or more of the plurality of flow restrictions.

In the embodiment shown in FIG. 2D, the fluid 263 entering the well screen assembly 122 through the filter portion 202 would typically flow through the chamber 232, through the third flow restriction 256, through the second flow restriction 254, through the first flow restriction 252, through the fluid pathway 210, to the second portion 236 of the fluid pathway 210, and then through the one or more ports 224 disposed in the wellbore tubular 206. The fluid 263 can then flow into the interior throughbore 218 of the wellbore tubular 206, which extends longitudinally through the flow control device as part of the tubular string 120. The fluid 263 may also flow outwardly through the filter portion 202 and/or the flow control device 204 along the reverse flow path.

Returning to FIG. 2A, a flow blockage 212 may be disposed in the fluid pathway 210 and may be retained in the fluid pathway 210 by a retaining member 214. The retaining member 214 may removably engage the housing 226 to allow for the disposition and/or removal of the flow blockage 212 within the fluid pathway 210. In an embodiment, the retaining member comprises an access plug having a threaded exterior that is configured to engage corresponding threads disposed on the housing 226. In an embodiment, the access plug may be press fitted, snap fitted, and/or retained in engagement with the housing 226 through the use of a retaining element such as a retaining clip (e.g., a split ring), set screw, or the like. In an embodiment comprising a plurality of fluid pathways 210 disposed in the housing 226 about the wellbore tubular 206, a corresponding retaining member 214 may be used with each fluid pathway 210 to allow for access to each individual fluid pathway 210.

The retaining member 214 may be accessible from an exterior 216 of the flow control device through an access port 230 that allows direct access to each individual fluid pathway 210. The access port 230 may be accessible from the exterior 216 without needing to remove any additional components of the flow control device and/or any other completion assembly components. Since the retaining member 214 may be directly exposed to the wellbore environment, the retaining member 214 may form a substantially fluid tight seal with the housing 226. One or more seals (e.g., o-ring seals, etc.) may be used to provide a seal between the retaining member 214 and the housing 226. The ability to directly access individual fluid pathways 210 may present an advantage relative to previous designs having a cover or sleeve that must be removed to access the interior fluid pathways 210.

The flow blockage 212 may serve to substantially prevent fluid flow through the fluid pathway 210 when disposed within the fluid pathway 210, and may comprise any mechanism capable of substantially preventing or blocking fluid flow through the fluid pathway 210. The flow blockage 212 may allow for selective restriction of one or more fluid pathways 210 in the housing 226. In combination with access through the retaining member 214, the arrangement of the flow blockage 212 within the fluid pathway 210 can be used to quickly configure and/or reconfigure the resistance to flow and/or pressure drop through the flow control device having a number of flow restrictions 208 that are fixed within the housing 226.

In an embodiment shown in FIG. 2A, the flow blockage 212 may comprise a rod or plug. The rod can be configured to be removably disposed within the fluid pathway and have a corresponding shape to mate with the fluid pathway 210. The rod may have a relatively small tolerance with respect to the fluid pathway 210 such that only a small annular gap may remain between the rod and the fluid pathway 210 when the rod is disposed within the fluid pathway 210. The rod may have a length sufficient to extend into the fluid pathway 210 beyond the one or more ports 222 disposed within the housing 226, thereby substantially preventing flow through the fluid pathway 210. In an embodiment, the rod may have a diameter greater than the pathway through the flow restriction (e.g., the central opening of a nozzle) and thereby be retained within the fluid pathway 210 between the retaining member 214 and the flow restriction 208. In some embodiments, the fluid pathway may comprise a narrowed portion (e.g., at shoulder 253 of FIG. 2B) to retain the flow blockage 212 within the fluid pathway 210. In an embodiment, the rod may not form a fluid tight seal with the fluid pathway 210. However, any small annular space between the outer surface of the rod and the inner surface of the fluid pathway 210 may form an annulus having a relatively high resistance to flow, which may be substantially greater than any resistance to flow through another fluid pathway 210 on the same or different flow control device. Due to the increased resistance to flow, a fluid flow may be substantially prevented through the fluid pathway 210 having the rod disposed therein. In an embodiment, one or more seals (e.g., o-ring seals) may be disposed in a recess on the rod and/or the fluid pathway 210 to provide a fluid tight seal between the rod and fluid pathway 210.

The rod may be removed from the fluid pathway 210 by removing the retaining member 214 from the housing 226, which may be accessed through the access port 230. The retaining member 214 and the access port 230 may be sized to allow for the removal of the rod. The rod may then be removed and the retaining member 214 can then be re-engaged with the housing 226 to allow flow through the fluid pathway 210. Similarly, the rod may be disposed within the fluid pathway by removing the retaining member 214 from the housing, and inserting the rod into the fluid pathway 210. The retaining member 214 can then be re-engaged with the housing 226, thereby substantially preventing fluid flow through the fluid pathway 210.

Figure 4:
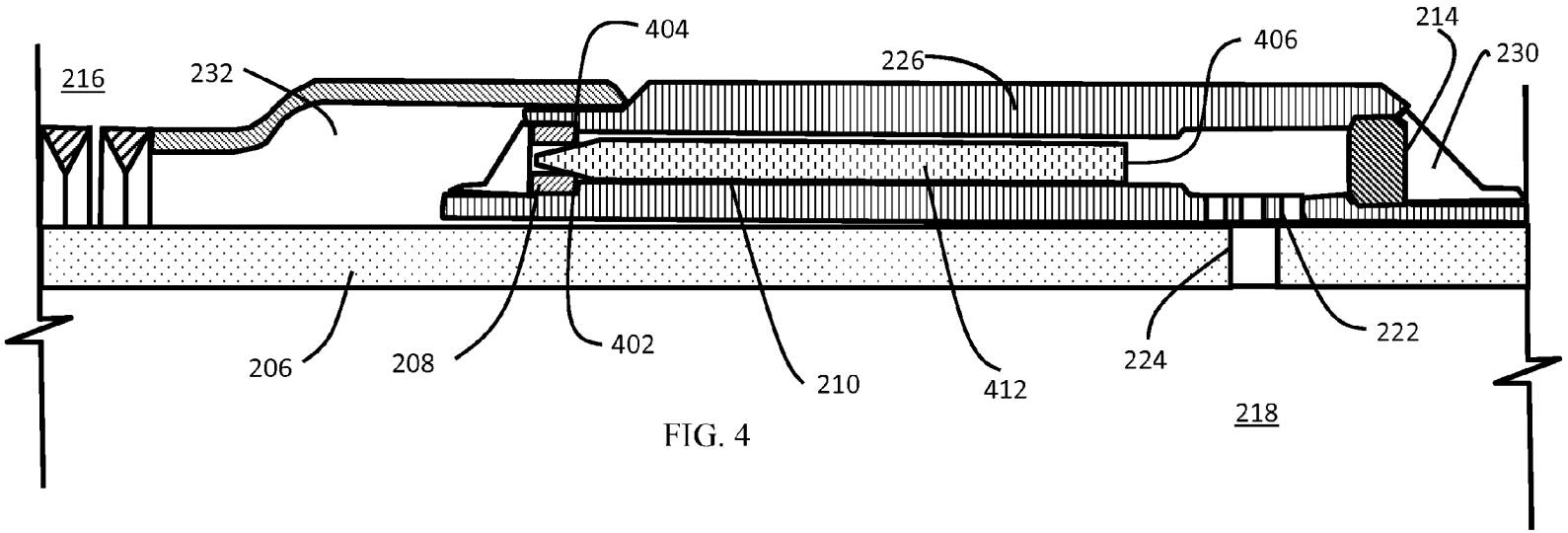
FIG. 4 is a partial cross-sectional view of a well screen assembly comprising still another embodiment of a flow control device.

In an embodiment illustrated in FIG. 4, another embodiment of a flow control device is shown. In this embodiment, the flow blockage 412 comprises a rod having a tapered (e.g., conical, frusto-conical, curved, etc.) end section 402. The rod may be disposed within the fluid pathway 210 so that a greater pressure within the interior throughbore 218 than the exterior 216 of the wellbore tubular 206 may act against an end 406 of the rod and bias the rod into contact with the flow restriction 208. The tapered end section may engage the opening of the flow restriction 208 (e.g., the central opening of a nozzle type flow restriction), which may have a corresponding angled and/or beveled seat 404. The interaction of the tapered end section 402 with the seat 404 may provide a substantially fluid tight seal against the flow of fluid through the fluid pathway 210 towards the chamber 232. In some embodiments, the rod may engage a narrowed portion of the fluid pathway 210 configured to form a seat rather than the flow restriction, thereby providing a substantially fluid tight seal against the flow of fluid through the fluid pathway 210.

When the pressure at the exterior 216 of the wellbore tubular 206 is greater than the pressure within the interior throughbore 218, the rod may be biased towards the retaining member 214 and retained in the fluid pathway 210 by the retaining member 214. In this configuration, the narrow annular gap between the exterior surface of the rod and the interior surface of the fluid pathway 210 may provide a substantial resistance to fluid flow, thereby substantially preventing a fluid flow through the fluid pathway 210. In an embodiment, one or more seals (e.g., o-ring seals) may be disposed in a recess on the rod and/or fluid pathway 210 to provide a fluid tight seal between the rod and fluid pathway 210, which may serve as a redundant seal with respect to the seal formed between the end of the tapered end section 402 and the flow restriction 208.

The rod may be removed from the fluid pathway 210 by removing the retaining member 214 from the housing 226, which may be accessed through the access port 230. The retaining member 214 and the access port 230 may be sized to allow for the removal of the rod. The rod may then be removed and the retaining member 214 can then be re-engaged with the housing 226 to allow flow through the fluid pathway 210. Similarly, the rod may be disposed within the fluid pathway 210 by removing the retaining member 214 from the housing, and inserting the rod into the fluid pathway 210. The retaining member 214 can then be re-engaged with the housing 226, thereby substantially preventing fluid flow through the fluid pathway 210.

Figure 5:
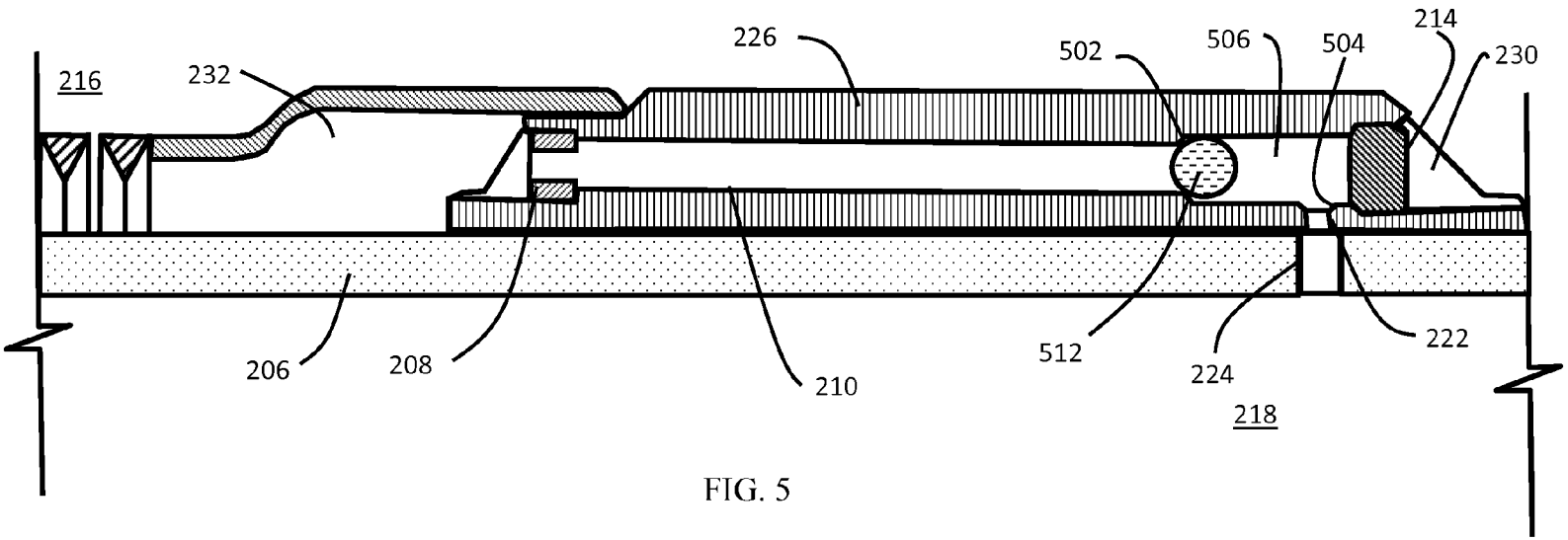
FIG. 5 is a partial cross-sectional view of a well screen assembly comprising yet another embodiment of a flow control device.

In an embodiment illustrated in FIG. 5, another embodiment of a flow control device is shown. In this embodiment, the flow blockage 512 comprises a ball. The ball may be formed from any suitable material and may be substantially spherical, though other shapes may also be possible. The ball may be disposed within a chamber 506 defined within the fluid pathway 210. The ball may have a diameter greater than the diameter of an opening 502 in fluid communication with the flow restriction 208, and greater than the diameter of an opening 504 of a port 222 disposed in the housing 226. In an embodiment, a flow restriction may be disposed in the place of port 222 and the opening 504 may comprise an opening of the flow restriction (e.g., the central opening of a nozzle type flow restriction), which may be disposed in a radial alignment. The opening 502 and/or the opening 504 may have a beveled and/or spherically matched surface to act as a seat for contacting the ball.

Upon an engagement between the ball and the opening 502 and/or the opening 504, the ball may form a substantial seal to fluid flow through the opening 502 and/or the opening 504, respectively. As noted herein, a perfect fluid seal is not needed since some amount of leakage may be allowable so long as the resistance to flow is substantially greater than through an alternative pathway between the exterior 216 of the wellbore tubular 206 and the interior throughbore 218. The ball may then substantially prevent fluid flow through the fluid pathway 210 upon the application of a pressure differential through the fluid pathway 210. For example, when a greater pressure exists within the interior throughbore 218 than the exterior 216 of the wellbore tubular 206, the pressure and any resulting fluid flow may act to bias the ball against the opening 502. The ball may engage the opening 502 of the fluid pathway and thereby form a seal against flow through the fluid pathway 210. Similarly, when the pressure at the exterior 216 of the wellbore tubular 206 is greater than the pressure within the interior throughbore 218, the ball may be biased against the opening 504. The ball may engage the opening 504 of the fluid pathway 210 and thereby form a seal against flow through the fluid pathway 210. In an embodiment, the opening 502 may have a diameter greater than the diameter of the ball. In this embodiment, the ball may be configured to engage an opening of the flow restriction 208 to thereby substantially form a seal.

The ball may be removed from the fluid pathway 210 by removing the retaining member 214 from the housing 226, which may be accessed through the access port 230. The retaining member 214 and the access port 230 may be sized to allow for the removal of the ball. The ball may then be removed from the chamber 506 and the retaining member 214 can then be re-engaged with the housing 226 to allow flow through the fluid pathway 210. Similarly, the ball may be disposed within the fluid pathway by removing the retaining member 214 from the housing 226, and inserting the ball into the chamber 506 within the fluid pathway 210. The retaining member 214 can then be re-engaged with the housing 226, thereby substantially preventing fluid flow through the fluid pathway 210.

Figure 6:
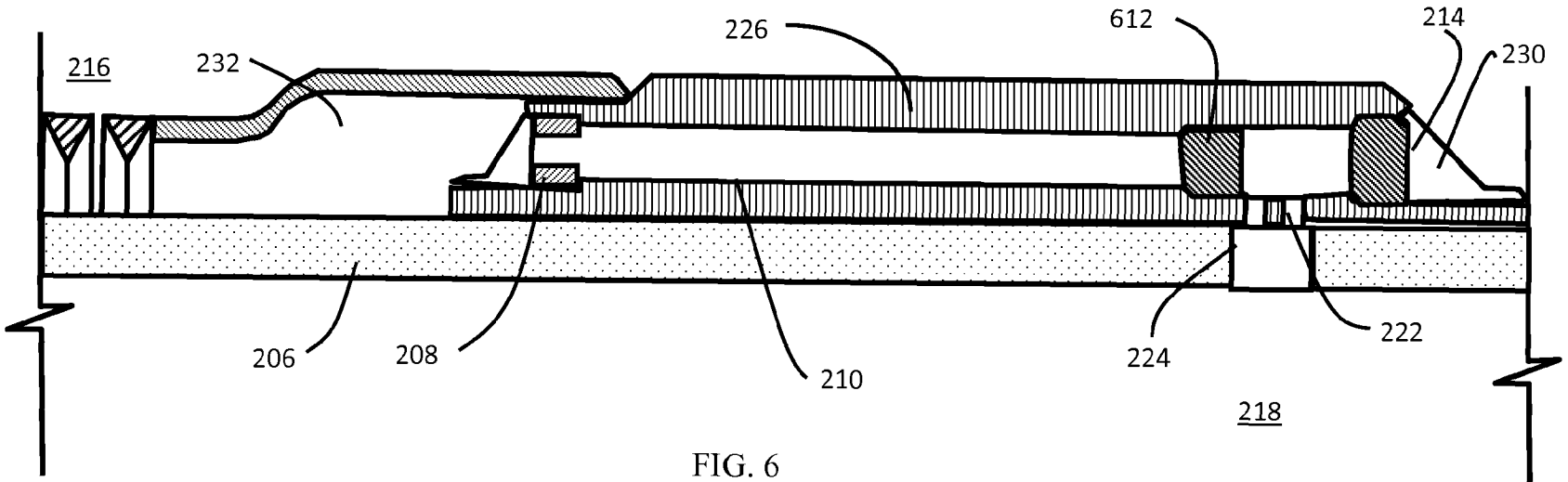
FIG. 6 is a partial cross-sectional view of a well screen assembly comprising another embodiment of a flow control device.

In an embodiment illustrated in FIG. 6, another embodiment of a flow control device is shown. In this embodiment, the flow blockage 612 comprises a plug disposed within the fluid pathway 210 between the flow restriction 208 and the port 222 in the housing 226. The plug may be removably and/or releasably engaged within the fluid pathway 210 using any suitable attachment mechanisms or means. In the embodiment illustrated in FIG. 6, the plug comprises a threaded exterior that is configured to engage corresponding threads disposed on an interior of the fluid pathway 210. In an embodiment, the plug may comprise a press fitting, snap fitting, and/or be retained through the use of a retaining element such as a retaining clip (e.g., a split ring), set screw, or the like. The plug may substantially prevent fluid flow through the fluid pathway 210. The plug may provide a substantially fluid tight seal based on the engagement of the plug with the fluid pathway 210. In an embodiment, one or more seals (e.g., o-rings) may be disposed in a corresponding recess in the plug and/or fluid pathway 210 to provide a seal between the plug and the fluid pathway 210.

The plug may be removed from the fluid pathway 210 by removing the retaining member 214 from the housing 226, which may be accessed through the access port 230. The retaining member 214 and the access port 230 may be sized to allow for the removal of the plug. The plug may then be disengaged from the fluid pathway 210 and removed from the flow control device. The retaining member 214 can then be re-engaged with the housing 226 to allow flow through the fluid pathway 210. Similarly, the plug may be disposed within the fluid pathway 210 by removing the retaining member 214 from the housing 226, and inserting the plug into the fluid pathway 210. The plug may then be engaged with the fluid pathway 210. The retaining member 214 can then be re-engaged with the housing 226, thereby substantially preventing fluid flow through the fluid pathway 210.

Figure 7:
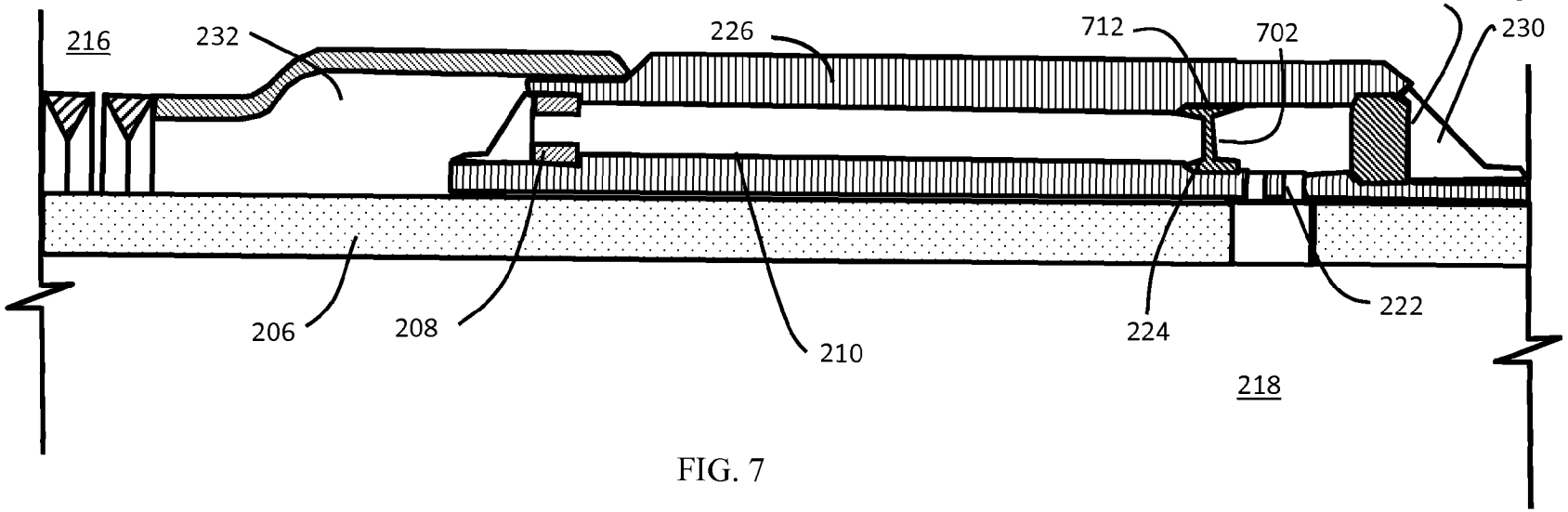
FIG. 7 is a partial cross-sectional view of a well screen assembly comprising still another embodiment of a flow control device.

In an embodiment illustrated in FIG. 7, another embodiment of a flow control device is shown. In this embodiment, the flow blockage 712 comprises a plug similar to the plug described with respect to FIG. 6. However, the plug illustrated in FIG. 7 comprises a thinned section 702 in the center of the plug. The plug can be configured to substantially prevent a fluid flow through the fluid pathway 210 and withstand the expected pressure differentials between the exterior 216 of the wellbore tubular 206 and the interior throughbore 218. The plug can also be configured to allow the thinned section 702 to be punctured and/or ruptured by an appropriate punch or perforating mechanism to thereby establish fluid communication through the plug. In the embodiment illustrated in FIG. 7, the plug comprises a threaded exterior that is configured to engage corresponding threads disposed on an interior of the fluid pathway 210. In an embodiment, the plug may comprise a press fitting, snap fitting, and/or be retained through the use of a retaining element such as a retaining clip (e.g., a split ring), set screw, or the like. The plug may substantially prevent fluid flow through the fluid pathway 210 prior to be punctured. In an embodiment, one or more seals (e.g., o-rings) may be disposed in a corresponding recess in the plug and/or fluid pathway 210 to provide a seal between the plug and the fluid pathway 210.

When engaged in the fluid pathway 210, fluid communication through the plug having the thinned section 702 may be established by removing the retaining member 214 from the housing 226, which may be accessed through the access port 230. The retaining member 214 and the access port 230 may be sized to allow for the use of a punch or other perforating mechanism to pass into the fluid pathway 210. The plug may then be punctured and/or ruptured to provide a fluid communication path through the plug. The retaining member 214 can then be re-engaged with the housing 226 to allow flow through the punctured plug along the fluid pathway 210.

In order to substantially prevent fluid flow through the fluid pathway 210, the ruptured plug may be replaced with a new plug. A new plug may be disposed within the fluid pathway 210 by removing the retaining member 214 from the housing, and removing the punctured plug from the fluid pathway 210. A new plug may then be inserted and engaged in the fluid pathway 210. The retaining member 214 can then be re-engaged with the housing 226, thereby substantially preventing fluid flow through the fluid pathway 210.

Figure 8:
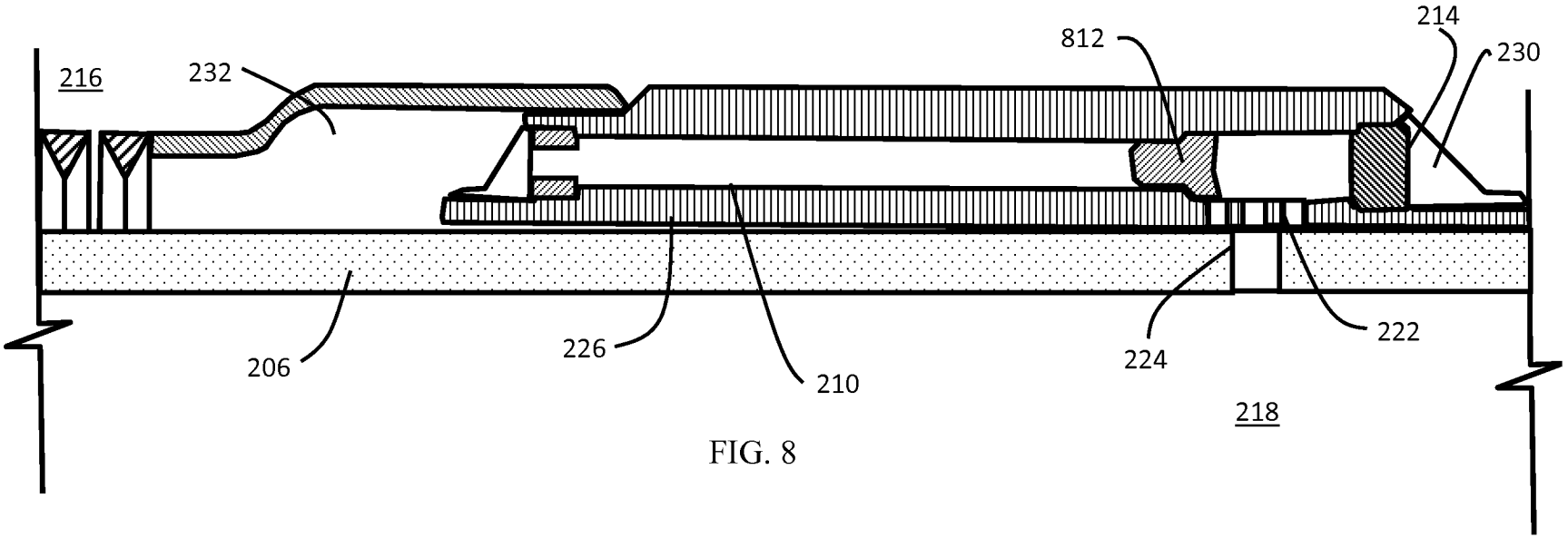
FIG. 8 is a partial cross-sectional view of a well screen assembly comprising yet another embodiment of a flow control device.

In an embodiment illustrated in FIG. 8, still another embodiment of a flow control device is shown. In this embodiment, the flow blockage 812 comprises a deformable plug. The deformable plug may comprise one or more deformable materials and may be configured to be disposed within the fluid pathway 210 by press fitting or other suitable method. Upon being press-fitted into the fluid pathway 210, the plug may deform (e.g., elastically and/or plastically) and engage the inner surface of the fluid pathway 210, thereby a substantially preventing fluid flow through the fluid pathway 210. Suitable materials useful in forming the deformable plug can include any number of relatively soft metals such as lead, zinc, copper, silver, antimony, gold, tin, bismuth, indium, aluminum, combinations thereof, and alloys thereof. In an embodiment, one or more suitable polymeric components may be used to form the deformable plug. Various polymeric components may be suitable for use in a downhole wellbore environment including but not limited to, nitrile rubbers (e.g., nitrile butadiene rubber, hydrogenated nitrile butadiene rubber, etc.), fluoropolymers (e.g., perfluoroelastomers, tetrafluoroethylene, tetrafluoroethylene/propylene mixtures), polyamides, ethylene propylene diene rubbers, and the like. Additional suitable materials capable of being deformed within the fluid pathway 210 may also be used.

In order to substantially prevent fluid flow through the fluid pathway 210, the retaining member 214 may be removed from the housing 226, which may be accessed through the access port 230. The deformable plug may then be disposed at least partially within the fluid pathway 210. The deformable plug may then be press fitted within the fluid pathway 210, thereby deforming the deformable plug and forcing the deformable plug within the fluid pathway 210. The deformable plug may then substantially prevent fluid flow through the fluid pathway 210. The retaining member 214 may then be reengaged with the housing 226.

When engaged in the fluid pathway 210, the deformable plug may be removed by first removing the retaining member 214 from the housing 226. In an embodiment, the deformable plug may be removed by grasping and removing the deformable plug. In an embodiment, the deformable plug may be drilled and/or milled out to remove at least a portion of the deformable plug, thereby establishing fluid communication through the deformable plug and along the fluid pathway 210. The retaining member 214 can then be re-engaged with the housing 226 to allow flow through any remaining portion of the deformable plug.

In an embodiment in which a plurality of fluid pathways is used with the flow control device, any of the flow restrictions, flow blockages, and methods of installing and/or removing the flow blockages in the fluid pathways may be used with any of the fluid pathways. Each of the fluid pathways may comprise the same type of flow blockages or different types of flow blockages. Further, each of the types of flow blockages may be used with any of the flow restrictions described herein. All of the combinations between the flow restrictions and flow blockages are envisioned as part of the flow control device described herein. It can also be noted from the description above that in each instance the flow blockage can be disposed in and/or removed from the fluid pathway without removing the one or more flow restrictions, which may be fixedly disposed within the fluid pathway.

In an embodiment, a plurality of flow control devices may be used with one or more wellbore tubular sections that may cover one or more intervals in a wellbore. A wellbore tubular string generally refers to a plurality of wellbore tubular sections connected together for conveyance within the wellbore. For example, the wellbore tubular string may comprise a production tubing string conveyed within the wellbore for producing one or more fluids from a wellbore. The number and type of flow control devices and the spacing of the flow control devices along the wellbore tubular may vary along the length of the wellbore tubular based on the expected conditions within the wellbore and locations of the intervals. In an embodiment, a plurality of flow control devices comprising one or more flow restrictions and/or fluid blockages disposed in one or more corresponding fluid pathways may form a portion of a wellbore tubular string. The wellbore tubular string may then be placed in the wellbore disposed in a subterranean formation and used to produce one or more fluids from the subterranean formation. In an embodiment, the flow control devices, which may form a portion of one or more well screen assemblies, may be used to balance the production from one or more intervals in the subterranean formation.

The ability to access the fluid pathways to dispose and/or remove a flow blockage within the fluid pathway may allow a flow control device to be reconfigured to provide a desired resistance to flow, and therefore, a desired flow rate through the flow control device for the expected conditions in the wellbore section. The flow control device may begin with flow blockages disposed in all of the fluid pathways, in none of the fluid pathways, or in some portion of the fluid pathways. The flow blockages may then be selectively adjusted by installing and/or removing a flow blockage in individual pathways to provide a desired resistance to flow through the flow control device as needed. In an embodiment, the flow blockages may be adjusted based on a variety of reasons including, but not limited to, the determination of a desired fluid resistance and/or flow rate.

In an embodiment, a flow control device may be provided comprising a plurality of fluid pathways between an exterior of a wellbore tubular and an interior of the wellbore tubular. Each fluid pathway may comprise one or more flow restrictions and one or more flow blockages configured to substantially prevent fluid flow through the fluid pathway. A corresponding plurality of retaining members may be configured to maintain the flow blockages within each fluid pathway. In this configuration, flow through all of the fluid pathways may be substantially prevented. In order to selectively adjust the flow control device to provide a desired resistance to flow, one or more of the flow blockages may be selectively removed from one or more of the plurality of fluid pathways using any of the methods described above. For example, the flow blockages may be removed from the fluid pathways having the appropriate combination of flow restrictions, which may each be the same, different, or any combination thereof, to provide the desired total resistance to flow through the flow control device. A fluid may then be allowed to flow through the one or more fluid pathways having the flow blockages removed. For example, the flow control device may be used to produce a fluid from a subterranean formation and/or inject a fluid into a subterranean formation through the one or more fluid pathways having the flow blockages removed.

Having a flow control device with all of the fluid pathways comprising flow blockages may be useful to provide some degree of adjustability to a wellbore tubular string comprising additional flow control devices that are configured for the expected wellbore conditions. In this embodiment, the one or more flow control devices may serve as backups along the string for use in adjusting the overall resistance to flow within a zone of the wellbore. For example, when an increased flow rate and/or decreased overall resistance to flow through a zone is desired, one or more of the flow blockages may be removed from the fluid pathways. The ability to access individual flow blockages may allow for a fine tuning of the flow rate and/or resistance to flow at any time prior to disposing the flow control device within the wellbore.

In an embodiment, a flow control device may be provided comprising a plurality of fluid pathways between an exterior of a wellbore tubular and an interior of the wellbore tubular. Each fluid pathway may comprise one or more flow restrictions while being free of any flow blockage. A plurality of retaining members may be configured to allow access to each fluid pathway and be accessible from an exterior of the flow control device without removing an additional component such as a cover or sleeve. In this configuration, flow through all of the fluid pathways may be allowed, thereby providing an overall resistance to flow resulting from the combination of the individual resistances to flow through each of the fluid restrictions. In order to selectively adjust the flow control device to provide a desired resistance to flow less than the overall resistance to flow, one or more of the flow blockages may be selectively disposed and/or installed within one or more of the plurality of fluid pathways using any of the methods described above. For example, flow blockages may be disposed in one or more fluid pathways to leave one or more open fluid pathways having the appropriate combination of flow restrictions, which may each be the same, different, or any combination thereof, to provide the desired total resistance to flow through the flow control device. A fluid may then be allowed to flow through the one or more fluid pathways without the flow blockages installed. For example, the flow control device may be used to produce a fluid from a subterranean formation and/or inject a fluid into a subterranean formation through the one or more fluid pathways without the flow blockages installed.

Having a flow control device without any fluid pathways comprising flow blockages may be useful to provide an initial assembly that can be adjusted as needed. For example, a plurality of flow control devices can be provided and selectively adjusted to provide a desired flow rate and/or resistance to flow based on the expected operating conditions within the wellbore. In this embodiment, one or more of the flow blockages may be installed to provide the desired resistance to flow at any point between being manufactured and being disposed within a wellbore.

In an embodiment, a flow control device may be provided comprising a plurality of fluid pathways between an exterior of a wellbore tubular and an interior of the wellbore tubular. One or more of the fluid pathways, but not necessarily all of the fluid pathways, may comprise one or more flow restrictions and one or more flow blockages configured to substantially prevent fluid flow through the corresponding fluid pathway. A plurality of retaining members may be configured to allow access to each fluid pathway and to maintain the flow blockages within each fluid pathway comprising a flow blockage. In this configuration, flow through each of the fluid pathways comprising a flow blockage may be substantially prevented. In order to selectively adjust the flow control device to provide a desired resistance to flow, one or more of the flow blockages may be selectively installed and/or removed from one or more of the plurality of fluid pathways using any of the methods described above. For example, the flow blockages may be installed and/or removed from one or more of the fluid pathways to provide the appropriate combination of flow restrictions, which may each be the same, different, or any combination thereof, to provide the desired total resistance to flow through the flow control device. A fluid may then be allowed to flow through the one or more fluid pathways clear of the flow blockages. For example, the flow control device may be used to produce a fluid from a subterranean formation and/or inject a fluid into a subterranean formation through the one or more fluid pathways clear of any flow blockages.

The flow control devices may be selectively adjusted at any point prior to being disposed in a wellbore. For example, the flow control devices can be manufactured with or without any flow blockages disposed in the fluid pathways. The flow control devices may then pass through various shipping and distribution centers where the fluid pathways may be selectively adjusted. When delivered to a wellsite for use in a wellbore, the flow control devices can be selectively adjusted at the surface prior to being disposed in the wellbore. Still further, the flow control device may be retrieved from a wellbore after being disposed within the wellbore. The flow control device can then be selectively adjusted after being retrieved and prior to be re-disposed within the wellbore.

In an embodiment, the flow control device may be selectively adjusted using any of the methods described above based on a determination of a desired fluid resistance and/or flow rate through the flow control device. In general, the fluid resistance and/or flow rate through a flow control device may be selected to balance the production of fluid along an interval. The determination of the fluid resistance and/or flow rate for an interval may be determined based on the desired production from the interval and the expected conditions within the interval including, but not limited to, the permeability of the formation within the interval, the total length of the interval, the types of fluids being produced from the interval, and/or the fluid properties of the fluids being produced in the interval. Once a desired fluid resistance and/or flow rate for an interval is determined, the flow control device may be selectively adjusted by installing and/or removing one or more flow blockages from one or more corresponding fluid pathways within the flow control device to provide a total fluid pathway having the desired fluid resistance and/or flow rate. In an embodiment, the flow control device may be selectively adjusted without removing the one or more flow restrictions. In an embodiment, the flow control device may be selectively adjusted by accessing the fluid pathway through a retaining member directly accessible from an exterior of the flow control device, without needing to remove a sleeve, cover, and/or other access mechanism.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k^{**}(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A flow control device comprising:

a housing comprising a shape to fit around a wellbore tubular;

a fluid pathway disposed through the housing in a generally longitudinal direction with respect to the wellbore tubular and configured to provide fluid communication between an exterior of the wellbore tubular and an interior of the wellbore tubular;

a flow restriction disposed along the fluid pathway, wherein the flow restriction is disposed within the housing such that an opening of the flow restriction is oriented in a direction substantially perpendicular to the longitudinal direction of the wellbore tubular; and a flow blockage disposed in the fluid pathway, wherein the flow blockage substantially prevents a fluid flow through the fluid pathway.

2. The flow control device of claim 1, wherein the flow restriction comprises a nozzle.

3. The flow control device of claim 1, wherein the flow blockage is disposed between the exterior of the wellbore tubular and the flow restriction.

4. The flow control device of claim 1, further comprising a second flow restriction disposed in the fluid pathway in series with the flow restriction.

5. The flow control device of claim 1, further comprising a retaining member removably engaged with an end of the housing in the longitudinal direction and configured to retain the flow blockage within the fluid pathway and allow access to the flow blockage within the fluid pathway.

6. The flow control device of claim 1, further comprising an access port in alignment with the flow restriction.

7. The flow control device of claim 1, wherein the fluid pathway comprises a narrowed portion configured to retain the flow blockage within the fluid pathway.

8. The flow control device of claim 1, wherein the flow blockage comprises at least one of a rod configured to be removably disposed within the fluid pathway, a rod comprising a tapered end section that is configured to sealingly engage a narrowed portion within the fluid pathway, a ball configured to engage one or more openings within the fluid pathway to substantially prevent the fluid flow through the fluid pathway, a plug configured to be removably disposed within the fluid pathway, a plug comprising a thinned section that is configured to be punctured to establish fluid communication through the plug, or a deformable plug configured to be disposed within the fluid pathway.

9. The flow control device of claim 1, wherein the flow blockage comprises a rod removably disposed in the fluid pathway, wherein the rod is elongated to substantially fill the fluid pathway in the generally longitudinal direction to substantially prevent a fluid flow through the fluid pathway.

10. A flow control device comprising:

a housing comprising a shape to fit around a wellbore tubular;

a fluid pathway disposed through the housing in a generally longitudinal direction with respect to the wellbore tubular and configured to provide fluid communication between an exterior of the wellbore tubular and an interior of the wellbore tubular;

a plurality of flow restrictions disposed in series in the fluid pathway;

a flow blockage comprising a rod that is removably disposed in the fluid pathway, wherein the rod is elongated to substantially fill the fluid pathway in the generally longitudinal direction to substantially prevent a fluid flow through the fluid pathway; and a retaining member configured to maintain the flow blockage within the fluid pathway and allow access to the flow blockage within the fluid pathway.

11. The flow control device of claim 10, wherein at least one of the plurality of flow restrictions is disposed within the housing such that an opening of the flow restriction is oriented in a direction substantially perpendicular to the longitudinal direction of the wellbore tubular.

12. The flow control device of claim 10, wherein the plurality of flow restrictions comprise at least one square edged restriction.

13. The flow control device of claim 10, wherein the plurality of flow restrictions comprise at least one restriction type selected from the group consisting of a nozzle, a restrictor tube, a narrow flow tube, an annular passage, a bent tube flow restrictor, and a helical tube.

14. The flow control device of claim 10, wherein the plurality of flow restrictions are configured to provide a different resistance to the flow of water than the flow of a hydrocarbon.

15. The flow control device of claim 10, wherein the flow blockage is disposed between at least two of the plurality of flow restrictions.

16. The flow control device of claim 10, wherein the retaining member is removably engaged with an end of the housing in the longitudinal direction and configured to retain the flow blockage within the fluid pathway and allow access to the flow blockage within the fluid pathway.

17. A method comprising:

providing a flow control device comprising:

a housing comprising a shape to fit around a wellbore tubular;

a plurality of fluid pathways disposed through the housing, each of the plurality of fluid pathways being disposed in a generally longitudinal direction with respect to the wellbore tubular and fluidly connecting an exterior of the wellbore tubular and an interior of the wellbore tubular, and a plurality of flow restrictions disposed along the plurality of fluid pathways, wherein at least one of the plurality of flow restrictions is disposed within the housing such that an opening of the flow restriction is oriented in a direction substantially perpendicular to the longitudinal direction of the wellbore tubular; and selectively installing or removing one or more flow blockages from the plurality of fluid pathways.

18. The method of claim 17, wherein one or more of the plurality of fluid pathways comprise two or more of the plurality of flow restrictions disposed in series.

19. The method of claim 17, wherein the plurality of flow restrictions are configured to provide a different resistance to the flow of water than the flow of a hydrocarbon.

20. The method of claim 17, further comprising selectively removing one or more of a plurality of retaining members from the housing to allow access to a corresponding one or more of the plurality of fluid pathways for installing or removing one or more of the plurality of flow blockages.

* * * * *